US008844459B2

(12) United States Patent
Perez

(10) Patent No.: US 8,844,459 B2
(45) Date of Patent: Sep. 30, 2014

(54) TUG-BARGE OFFSHORE CARGO TRANSPORT

(76) Inventor: Robert H. Perez, Houma, LA (US)

( * ) Notice: Subject to any disclaimer, the term of this patent is extended or adjusted under 35 U.S.C. 154(b) by 413 days.

(21) Appl. No.: 13/385,696

(22) Filed: Mar. 2, 2012

(65) Prior Publication Data

US 2012/0226636 A1 Sep. 6, 2012

Related U.S. Application Data

(60) Provisional application No. 61/464,279, filed on Mar. 2, 2011.

(51) Int. Cl.

| | |
|---|---|
| ***B63B 21/56*** | (2006.01) |
| ***B63B 35/70*** | (2006.01) |
| ***B63B 35/28*** | (2006.01) |

(52) U.S. Cl.

CPC ..... *B63B 35/70* (2013.01); *B63B 35/28* (2013.01)

USPC ..... 114/248; 114/144 RE

(58) Field of Classification Search

USPC ..... 114/151, 248, 249, 251, 144 RE

See application file for complete search history.

(56) References Cited

U.S. PATENT DOCUMENTS

| | | | | |
|---|---|---|---|---|
| 4,048,941 | A * | 9/1977 | Legnos | 114/248 |
| 4,356,784 | A * | 11/1982 | Waters et al. | 114/248 |
| 5,522,335 | A * | 6/1996 | Veronesi et al. | 114/151 |
| 5,558,036 | A * | 9/1996 | Hara | 114/249 |
| 7,104,212 | B2 * | 9/2006 | Brianza | 114/144 RE |
| 7,404,369 | B2 * | 7/2008 | Tracht et al. | 114/144 RE |
| 8,141,508 | B2 * | 3/2012 | Levander | 114/248 |

* cited by examiner

*Primary Examiner* — Lars A Olson

(74) *Attorney, Agent, or Firm* — David B. Dickinson

(57) ABSTRACT

Disclosed is a tug-barge offshore cargo transport device and method, comprised of two separate elements which are removably attached: a barge and a tug boat. The barge includes a bow shaped to cut through and deflect waves, a rectangular cargo deck protected by a bulwark, compartments below the cargo deck, means for maneuvering the barge, and means at the stern of the barge for removably attaching the barge to a tug boat. The tug boat includes means at the bow to removably attach to the barge, and means to control the means for maneuvering the barge from the tug boat.

15 Claims, 3 Drawing Sheets

TUG-BARGE OFFSHORE CARGO TRANSPORT

This application claims the benefit of U.S. Provisional Application(s) No. 61/464,279 Mar. 2, 2011.

FIELD OF THE INVENTION

The present invention is for a Tug-Barge Offshore Cargo Transport ("TBOCT") for delivering cargo to offshore oil platforms and the like. Currently, oil platforms and drilling rigs at sea are re-supplied using oilfield supply vessels, ships specifically designed for this duty. The TBOCT device of the present invention includes design elements which improve the ability of vessels to re-supply oil platforms. Although the TBOCT will be described for use in supplying oil platforms at sea, it is not limited to this application, and persons skilled in the art will appreciate this and other uses for the TBOCT.

BACKGROUND OF THE INVENTION

Typical current oilfield supply vessels are comprised of one single hull form, primarily composed of two rigidly joined elements (permanently attached to form a single vessel): an elevated pilothouse located near the bow of the vessel and a low cargo deck located behind the pilothouse and extending towards the stern of the vessel. The cargo deck of a typical oil field supply vessel has approximately 3 feet of freeboard (i.e. height of the sidewalls of the vessel above the waterline) when loaded. Thus, the design of the typical oil field supply vessel must locate the pilothouse forward, so that the pilothouse may shield the cargo on the low cargo deck from waves while the vessel is motoring. Due to this design configuration, the oilfield supply vessel must be maneuvered to back into mooring, so that the aft cargo deck can be easily offloaded (i.e. so that the cargo deck is located next to the oil platform for accessibility). This fact complicates mooring, however, since piloting a ship in reverse is more difficult than piloting forward. When mooring with oil platforms out at sea, standard operating procedure requires vessels to approach the oil platform downwind. Thus, a current oilfield supply vessel must maneuver backwards against the wind and seas as it approaches the oil platform. In this situation, the low cargo deck is unsheltered and takes on a great deal of green water (i.e. waves which sweep over the side of the vessel and onto the deck), endangering both cargo and crew. Furthermore, the oilfield supply vessel, which has a fairly high center of gravity due to the elevated superstructure of the pilothouse, would experience significant roll in these conditions, complicating mooring and offloading and increasing the risk for personnel on the cargo deck. The present invention addresses these and other concerns in an attempt to provide an improved means for supplying offshore oil platforms.

SUMMARY OF THE INVENTION

The TBOCT is comprised of two separate elements which are removably attached: a barge and a tug boat. The design of the barge and the tug provide for a conjoint unit, in which the separate elements of the barge and the tug boat, each of which may be used independently, may be linked together to form a single, complete cargo transport vessel capable of use on the high seas. Both the tug boat and the barge elements of the TBOCT are specially designed to allow for an effective coupling, so that when both elements are latched together, they act as a single, united vessel.

It is an object of this invention to more efficiently and safely supply offshore oil platforms by replacing the current oil field supply vessels with TBOCT units. It is another object of this invention to provide for separate barge and tug boat elements which can be removably latched together to form a unitary, articulated TBOCT vessel suitable for use on the high seas. It is yet another object to provide TBOCTs which are capable of mooring in a forward direction. It is yet another object to provide for maneuverable TBOCT vessels with one or more positioning thrusters located on the barge elements to assist the tug boat in steering the TBOCT.

It is yet another object to employ a design which eliminates green water overflow onto the cargo deck, so that the cargo deck of the barge may be located forward of the tug boat. It is yet another object to employ a design with a low center of gravity in order to diminish the roll of the vessel upon the sea. It is yet another object for the TBOCT to be comprised of two separate elements (a tug boat and a barge) which may be latched together durably to form a single conjoint unit, and may then be uncoupled so that the tug element may remain in use while the barge element is being loaded. It is yet another object to provide a more efficient and cost-effective manner in which to re-supply offshore oil platforms, by minimizing the downtime of the tug boat element during loading and unloading.

BRIEF DESCRIPTION OF DRAWINGS

Reference will be made to the drawings, where like parts are designated by like numerals and wherein.

DETAILED DESCRIPTION OF THE PREFERRED EMBODIMENT

Figure 1:
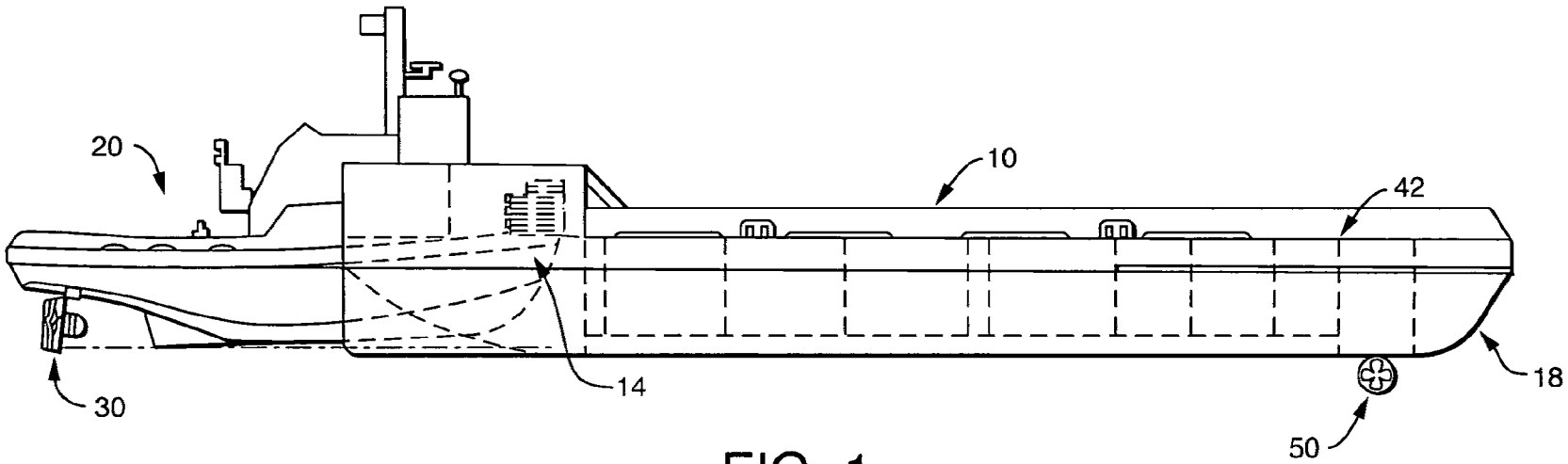
FIG. 1 is a profile view of the TBOCT.

In the preferred embodiment, shown in the accompanying drawings, the barge 10 is designed with a notch 12 in its stern for receiving the bow 14 of the tug boat 20. The tug boat 20 is designed accordingly, so that it can effectively fit into the notch 12 in the stern of the barge 10 and so that it can latch onto the barge 10 to provide a unitary vessel. While this type of latching structure is not essential, it is preferred since it allows for a fairly simple latching maneuver and for an effective coupling in which the TBOCT acts as a unitary vessel. A person skilled in the field will recognize and appreciate, however, that other types of attachment means would also be suitable.

Although a variety of tug boat designs may be used within the overall TBOCT concept, the tug in the preferred embodiment utilizes one or more Z-drive propulsion units 30. A Z-drive is a type of propulsion unit which utilizes a propeller with approximately a 360 degree range of motion with a nozzle around the propeller. In the preferred embodiment, two Z-drives 30 are located near the stern of the tug boat 20 in a position such that the Z-drives are back beyond the connection to the barge 10 when the tug 20 is latched into place within the notch 12 on the barge 10 (see FIG. 1). This positioning ensures that the Z-drives 30 have a full, unimpeded range of motion, providing the TBOCT with maximum maneuverability, and that the Z-drives 30 draw a sufficient amount of water to propel the TBOCT effectively though the water (cruising at a speed of approximately 11 to 13 knots).

Obviously, other types of propulsion units, such as a conventional shaft drive unit, could also be used aboard the tug boat 20 element of the TBOCT.

Figure 2:
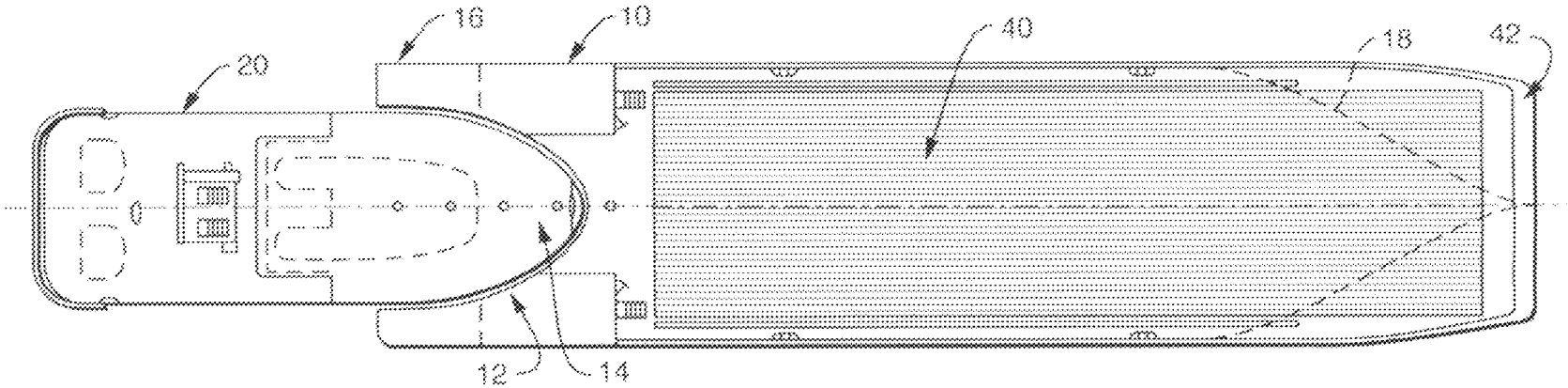
FIG. 2 is an overhead view of the TBOCT showing the deck.

The barge 10 element of the preferred embodiment of the TBOCT has a notch 12 in its stern (for mating with the tug element 20), with a cargo deck area 40 forward (see FIG. 2). In the preferred embodiment, the barge element 10 of the TBOCT has approximately 7 feet of freeboard (i.e. height of the sidewalls of the barge 10 above the waterline), and the cargo deck 40 of the barge element 10 of the TBOCT is rimmed with a bulwark 42 which shields the cargo deck 40 from waves (shown in FIGS. 1 and 2). The bulwark 42 acts to provide additional freeboard (of approximately 5 feet in the preferred embodiment), without significantly raising the center of gravity of the cargo deck 40.

The barge 10 of the preferred embodiment also includes one or more integrated thrusters 50, which improve the maneuverability of the TBOCT. Although any type of positioning thruster may be utilized, in the preferred embodiment, a retractable Z-drive is located underneath the barge 10 near the bow, as is shown in FIG. 1. The benefit of the Z-drive thruster 50 is that it provides for rotational thrust, allowing thrust to be directed within an approximately 360 degree range. By being located underneath the barge 10 (see FIG. 1), the range of motion of the Z-drive 50 is unobstructed. This Z-drive 10 is retractable in the preferred embodiment in order to reduce the chances of it being damaged (by contact with the ground) during docking at harbor.

Other types of thrusters, such as a tunnel thruster (which is an open tube running through the hull from one side of the barge 10 to the other side, with a propeller located within the tube), could also be used. A tunnel thruster, however, would only allow for directional thrust (rather than rotatable thrust), and a TBOCT so equipped would not be as maneuverable as one with a Z-drive 50. Another type of thruster available for use aboard the barge element 10 of the TBOCT is a knuckle thruster (which is a retractable pivoting thruster which initially rests in a tube and acts similar to a tunnel thruster, but which may be extended outside of the tube to provide rotational thrust). The preferred positioning of at least one thruster is near the bow of the barge 10, since that would provide the pilot with thrust capabilities from both the front (using the positioning thruster) and the rear (using the tug boat 20) of the TBOCT. Specific thruster locations will depend greatly upon the characteristics of the barge 10. For example, a large barge element 10 might preferably locate one thruster 50 at the bow and one thruster 50 on each side of the stern of the barge 10. Obviously, these are merely examples of the types and positions of positioning thrusters 50 which may be integrated within the barge element 10 of the TBOCT; a person skilled in the art field will appreciate a variety of compatible alternatives and functional equivalents.

Figure 3:
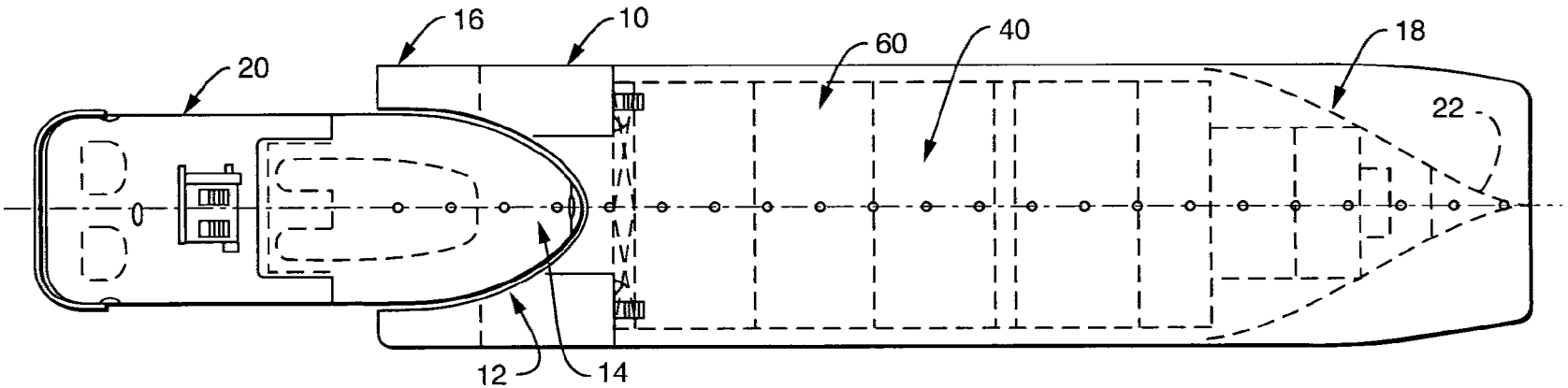
FIG. 3 is an overhead view of the TBOCT showing the hold.

The preferred embodiment of the barge element 10 of the TBOCT also employs a sleeker hull design than a traditional barge or an oil field supply vessel, in order to deflect waves generated during motoring and to reduce drag (thereby improving fuel efficiency). The rear 16 of the barge 10 is generally rectangular in shape (but with a notch 12 in the stern). The lower portion of the bow 18 (best seen in outline in FIG. 3) of the barge 10 flares out symmetrically from the centerline until it meets the rectangular rear portion of the barge 10. Thus, the shape of the hull of the lower bow 18 of the barge 10 (i.e. the portion of the bow of the barge 10 which is underneath the surface of the water) in the preferred embodiment of the TBOCT, from the centerline of the vessel to the outer sidewall of the rectangular rear portion 16 of the barge 10, is approximately that of a tangential mathematical curve function between two limits, smoothly connecting the frontmost portion 22 of the bow (at the centerline) to the rectangular rear portion 16 of the barge 10. This smooth profile (which can be seen clearly in FIGS. 2 and 3) slices though the water and creates a bow wake which directs waves away from the TBOCT in order to greatly reduce the amount of green water coming onto the cargo deck 40 of the TBOCT.

The cargo deck 40 (best seen in FIG. 2) rests atop the shaped hull of the barge 10. In the preferred embodiment, the cargo deck 40 is essentially flat and rectangular (providing a large surface area for cargo), and is sized so that it is as wide as the rectangular rear 16 of the barge hull and extends from the rectangular rear 16 of the barge hull (at a point forward of the notch 12 into which the tug 20 docks) to the foremost point of the bow 22. In the preferred embodiment, the surface of the cargo deck 40 is constructed of wooden planking in order to reduce the movement of cargo as the TBOCT rolls. The cargo deck 40 of the preferred embodiment also includes tie-down locations, for strapping cargo to the deck securely, and cargo containment rails, which protect the bulwarks 42 from impact damage by preventing the cargo from shifting into the bulwarks 42. The hull shape of the barge 10 acts to ameliorate the green water coming onto the cargo deck 40, with the bow wake dampening the effect of waves in order to protect the cargo deck 40 so that a forward pilothouse is unnecessary.

By design, the bulk of the barge element 10 of the TBOCT will ride beneath the surface of the water (see FIG. 1), with additional cargo carrying capacity in the hull below the cargo deck 40. Thus, even though the barge 10 has additional freeboard over the typical oilfield supply vessel, it nevertheless has a lower overall center of gravity and is more stable than existing oilfield supply vessels. The remaining features of the barge element 10 of the TBOCT are fairly typical of barges in general. For example, within the hull of the barge 10, located below the cargo deck 40, are several compartments or tanks 60 (see FIG. 3). The compartments or tanks 60 may hold a variety of substances, including fuel, water, dry bulk products, and liquid mud for the oil platforms and ballast for the TBOCT. The preferred embodiment also has a compartment for the retractable Z-drive thruster 50, so that the Z-drive thruster 50 can be safely housed within the confines of the hull structure of the barge 10 to be shielded from impact that could damage the thruster 50. The preferred embodiment also includes a pump room and a generator room.

The barge 10 may also be equipped with means to automatically adjust the ballast during loading or offloading of cargo such that the draft of the vessel is maintained at a constant level. This not only aids in the loading and offloading of the vessel, particularly when offshore, but also aids in maintaining position, particularly offshore in rough seas, during unloading and loading of cargo. Operation of the ballast system pumps may be facilitated by use of a wireless operating network from controls in the tug 20 and aboard the barge unit 10, or even from a location not on the tug 20 or barge unit 10.

In use, the tug boat 20 and the barge element 10 of the TBOCT are latched together securely when the TBOCT is motoring, with the tug boat 20 providing the driving force of propulsion for the barge 10. While the connection between the tug 20 and the barge 10 may be a rigidly locking joint (for an integrated tug-barge vessel), as in U.S. Pat. Nos. 4,356,784 and 4,048,941, in the preferred embodiment, the TBOCT is an articulated tug-barge with a pivoting connection, allowing the tug 20 to pivot with relation to the barge 10 in a hinged motion to reduce the impact of the waves on the joint between the tug 20 and the barge 10, but restraining motion in the remaining directions so that the tug 20 and the barge 10 roll together in order to reduce the amount of roll experienced by the crew aboard the tug boat 20. This type of articulated joint optimizes the ride characteristics of the TBOCT, while maintaining a durable connection between the separate elements.

An example of such a detachable, articulated joint is found in U.S. Pat. No. 6,199,501, which employs two rams, which extend from the sides of the tug, to engage the teeth of vertical channels along the inner surface of the notch in the barge. When the rams are extended to latch into the vertical channels in the notch of the barge, the tug is free to pitch independently from the barge (so that the wave action does not weaken the joint between the barge and the tug over time), but is firmly restrained in all other directions, so that the TBOCT acts as a single, unitary, conjoint vessel. This minimizes the roll experienced by crew members onboard the tug 20 and allows the tug boat 20 to act as the propulsion unit for the entire TBOCT. Persons skilled in the art field will recognize that this is just one method for latching a tug to a barge in an articulated manner, and will appreciate other, compatible means for latching the separate tug boat element of the TBOCT to the separate barge element of the TBOCT. For example, the tug could also latch to the barge element of the TBOCT with a hydraulic clamp used in conjunction with pad modules.

The design of the TBOCT is lower in the water and wider of breadth than current oilfield supply vessels, in order to reduce roll and to increase stability. While oil field supply vessels employ an elevated pilothouse which raises the center of gravity of the vessel, the TBOCT has a lower center of gravity due to the lower profile of the tug boat 20 and the larger volume of the barge 10 hull located beneath the waterline. The design of the barge 10 also incorporates a shield wall or bulwark 42 around the cargo deck area 40 in order to further protect the cargo deck 40 from waves while minimizing the center of gravity of the barge 10. The design of the barge 10 also incorporates a sleeker forward design for the hull of the barge 10, so that the barge 10 slices through waves effectively to improve cruising on the open seas while dissipating wave action upon the barge 10 in an effort to reduce the amount of green water experienced by the TBOCT. The combination of the design of the forward hull of the barge 10, which creates a bow wake, and the bulwarks 42 around the cargo deck 40 of the barge 10 eliminates the need to locate the pilothouse at the bow of the vessel (as in conventional oil field supply vessels), allowing the TBOCT to position for mooring in a forward direction.

In the preferred embodiment, the one or more positioning thrusters 50 can be operated either remotely from the pilothouse of the tug boat 20 or using emergency controls aboard the barge 10. Operation of the positioning thrusters 50 may also be facilitated by wireless operating network from controls in the tug 20 and aboard the barge unit 10, or even from a location not on the tug 20 or barge unit 10. The primary use of the thrusters 50 aboard the barge unit 10 of the TBOCT is to improve the maneuvering characteristics of the TBOCT in conjunction with the primary thrust provided by the tug boat 20. If necessary, however, the thrusters 50 could be used independently (i.e. without the tug boat 20) for small-scale maneuvering of the barge 10 or for emergency power to slowly move the TBOCT. The improved maneuverability provided by adding thrusters 50 to the barge 10 is especially useful when attempting to moor the TBOCT with an offshore oil platform in challenging sea conditions.

In use, the TBOCT typically approaches an offshore oil platform upwind for docking, as required by standard operating procedure. Because of its design (with the tug boat 20 latched into the notch 12 in the stern of the barge 10), the TBOCT is able to approach the oil platform ahead (i.e. in a forward motion), reducing the piloting difficulty for the mooring procedure. The amount of green water taken on during docking is greatly reduced by the design of the TBOCT, since the hull design acts to break up wave action and the bulwarks 42 increase the freeboard height of the TBOCT. Furthermore, the lower center of gravity reduces the roll experienced by the TBOCT. All of these features protect the cargo deck 40 and improve the safety of personnel operating on the cargo deck 40 during offloading. Finally, the TBOCT can be fitted with a Global Positioning System ("GPS") computer for dynamic positioning, in which the actual mooring process is computer-controlled. The additional thrusters 50 aboard the barge 10 enhance this dynamic positioning process, by providing increased control during mooring and the ability to more effectively hold position during offloading.

The detachable nature of the TBOCT (in which the tug boat 20 can latch onto the barge 10 to form a single, conjoint unit, and can unlatch from the barge 10 to act independently) also allows for a more efficient and economical use of the TBOCT when compared to a standard oilfield supply vessel. A standard oilfield supply vessel arrives at port and sits idle during offloading and loading of cargo. Only once it has been completely loaded can the oilfield supply vessel depart on a supply run to an offshore oil platform, meaning that the vessel experiences a great deal of downtime over the course of its life. The TBOCT, however, minimizes this downtime. A TBOCT would arrive at port and would dock the barge 10 for offloading and loading of cargo. The tug boat 20 could then uncouple from the barge 10, leaving the barge 10 at dock for loading while the tug boat 20 is available for use with another, pre-loaded barge 10. Thus, each portion of the TBOCT can be utilized separately for task specific functions, and then brought together only at the final moment for conjoint operation; both the barge elements 10 and the tug boat elements 20 can be in nearly continuous use with only a minimum of downtime. This reduction of idle time translates into an increase in productivity and profitability.

Furthermore, production of both barges 10 and tug boats 20 are more economical than construction of oilfield supply vessels. Barges 10 and tug boats 20 are fairly simple structures, and industry is already organized to build both en mass. This eliminates the need for specialized construction facilities. Thus, construction costs for the TBOCT should be advantageous. Use of TBOCT elements provides scheduling advantages, since the optimum number of each element (tugs/barges) can be purchased to mix and match in order to maximize the effective life of the elements and the productivity of the TBOCT. As oilfields move farther offshore around the world, this vessel will enable the movement of more tonnage per voyage than any vessel currently existing today.

These and other uses will be apparent to persons skilled in the art field from this written description and the accompanying drawings of the preferred embodiment. The preferred embodiments described herein are illustrative and do not limit the scope of this invention or the scope of patent protection arising from this application in any way. For instance, a variety of means for latching the tug 20 to the barge 10 and a variety of means for providing additional thrust to position the barge 10 are contemplated to be within the scope of this invention; the preferred embodiments disclosed herein are not restrictive or exclusive, and they explicitly include any equivalents known to persons skilled in the art field. Furthermore, any patents listed herein by way of example are specifically incorporated by reference. The full scope of this invention will be set forth in the detailed claims provided in the utility patent application which is to follow.

What I claim is:

1. An offshore cargo transport comprising:

a tug boat; and a barge;

wherein said tug boat and said barge are removably attached in an articulated manner;

wherein said barge further comprises one or more means for maneuvering, a cargo deck, and a bulwark;

wherein said tug boat and said barge provide a wireless control system to control said one or more means for maneuvering the tug and barge as a unitary unit and to control means to adjust the ballast in said barge during loading and offloading of cargo from said barge whereby the draft of said barge is maintained at a constant level; and wherein the bow of said barge is shaped to cut through and deflect waves, creating a bow wake to reduce the amount of water washed onto the cargo deck.

2. An offshore cargo transport as in claim 1 wherein said means for maneuvering said barge comprises one or more Z-drive propulsion units.

3. An offshore cargo transport as in claim 2 wherein at least one of said one or more Z-drive propulsion units is located near the bow of said barge.

4. An offshore cargo transport as in claim 2 wherein said one or more Z-drive propulsion units are retractable into the hull of said barge.

5. An offshore cargo transport as in claim 1 wherein said tug boat is propelled by one or more Z-drive propulsion units.

6. An offshore cargo transport as in claim 1 wherein said means for maneuvering said barge comprises one or more Z-drive propulsion units and said tug boat further comprises one or more Z-drive propulsion units permitting coordinated movement of the barge and tug boat cargo.

7. An offshore cargo transport as in claim 1 wherein said bulwark extends above said cargo deck to provide additional protection to said cargo deck.

8. An offshore cargo transport as in claim 1 wherein said bulwark extends above said cargo deck to provide approximately five feet of additional freeboard for said barge.

9. An offshore cargo transport as in claim 1 further comprising one or more compartments beneath said cargo deck within the hull of said barge.

10. An offshore cargo transport as in claim 9 wherein said one or more compartments beneath said cargo deck lie below the water line when said barge is loaded, whereby the center of gravity of said barge is lowered, reducing roll of said cargo transport in rough seas.

11. An offshore cargo transport as in claim 1 wherein the stern of said barge further comprises a notch shaped to fit the bow of said tug boat.

12. An offshore cargo transport as in claim 1 wherein said cargo deck is rectangular shaped and extends forward to the bow of said barge.

13. An offshore cargo transport as in claim 1 wherein said means for maneuvering said barge can be controlled from said tug boat.

14. An offshore cargo transport as in claim 1 wherein the wireless control system further provides means to adjust the ballast in said barge during loading and offloading of cargo from said barge whereby the draft of said barge is maintained at a constant level.

15. A method for supplying offshore platforms using an articulated tug-barge vessel comprising the steps of:

loading a first barge with supplies for an offshore platform;

connecting a tug boat to said loaded first barge to form a unitary vessel;

using said tug boat to power said loaded first barge to an offshore platform;

loading a second barge with supplies for an offshore platform while said tug boat powers said loaded first barge to an offshore platform;

unloading said first barge at the offshore platform;

using said tug boat to return said unloaded first barge to a loading area;

disconnecting said tug boat from said unloaded first barge, and connecting said tugboat to said loaded second barge to form a unitary vessel; and, using said tug boat to power said second barge to an offshore platform.

* * * * *